US010052882B2

(12) United States Patent
Suzuki

(10) Patent No.: US 10,052,882 B2
(45) Date of Patent: Aug. 21, 2018

(54) PRINT CONTROL APPARATUS, PRINT CONTROL METHOD, AND PROGRAM

(71) Applicant: SEIKO EPSON CORPORATION, Tokyo (JP)

(72) Inventor: Masato Suzuki, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 274 days.

(21) Appl. No.: 14/619,192

(22) Filed: Feb. 11, 2015

(65) Prior Publication Data

US 2015/0224768 A1 Aug. 13, 2015

(30) Foreign Application Priority Data

Feb. 12, 2014 (JP) ..... 2014-024408

(51) Int. Cl.
*B41J 2/14* (2006.01)
*B41J 2/21* (2006.01)

(52) U.S. Cl.
CPC ..... *B41J 2/2132* (2013.01)

(58) Field of Classification Search
CPC ..... B41J 19/142; B41J 2/2054
See application file for complete search history.

(56) References Cited

U.S. PATENT DOCUMENTS 4,463,359 A * 7/1984 Ayata et al. ..... 347/56
5,984,454 A * 11/1999 Takahashi et al. ..... 347/43
6,137,507 A 10/2000 Inui et al.
6,283,569 B1 * 9/2001 Otsuka et al. ..... 347/15
6,371,608 B1 4/2002 Kato et al.
6,966,621 B2 11/2005 Takahashi et al.
6,994,413 B2 * 2/2006 Otsuka ..... B41J 2/2135 347/14
8,353,569 B2 * 1/2013 Takahashi ..... B41J 2/2056 347/14
2002/0024558 A1 * 2/2002 Fujita et al. ..... 347/43
2002/0158942 A1 10/2002 Kaneko et al.
2009/0153606 A1 * 6/2009 Mizutani et al. ..... 347/12
2011/0227978 A1 * 9/2011 Matsumoto ..... 347/12

FOREIGN PATENT DOCUMENTS

JP 10-044394 A 2/1998
JP H10-278250 A 10/1998
JP 2002-248798 A 2/2001
JP 2004-142452 A 5/2004
JP 2007-268743 A 10/2007

* cited by examiner

*Primary Examiner* — John P Zimmermann
(74) *Attorney, Agent, or Firm* — Maschoff Brennan

(57) ABSTRACT

A print control apparatus which controls ejection of fluid from a nozzle array in which a plurality of nozzles are arranged in lines, and movement of the nozzle array in a direction intersecting a direction in which the nozzles are arranged in lines, in which the ejection of the fluid to the continued regions is performed by a plurality of movements of the nozzle array when an ejection amount of the fluid to continued regions in one movement of the nozzle array exceeds a predetermined threshold value.

8 Claims, 9 Drawing Sheets

PRINT CONTROL APPARATUS, PRINT CONTROL METHOD, AND PROGRAM

CROSS-REFERENCE TO RELATED APPLICATIONS

This application claims priority to Japanese Patent Application No. 2014-024408 filed on Feb. 12, 2014. The entire disclosure of Japanese Patent Application No. 2014-024408 is hereby incorporated herein by reference.

BACKGROUND

1. Technical Field

The present invention relates to a print control apparatus, a print control method, and a program.

2. Related Art

In an ink jet printer that performs printing by ejecting ink, the high density of the recording heads is progressing. In addition, together with this, various kinds of technologies are developed.

JP-A-2004-142452 discloses that, in a multipass recording method in which a predetermined recording region is completed by the plurality of times of scanning of a recording head, an ink application amount is controlled by considering the relationship between the scanning number (pass number) thereof and the degree of the adverse effect of the air stream. That is, in order to avoid the adverse effect of the air stream, the application amount of the ink according to the number of passes is controlled.

In addition, JP-A-10-278250 discloses that, if a recording duty is equal to or greater than a predetermined threshold value, a division record is performed.

Since the high density of the recording heads is progressing, and the ink is ejected from nozzles arranged in lines at a high density at the same time, the plurality of times of ejection influences each other. Also, if the plurality of shots of ejection influence each other and the recording head moves in the main scanning direction, so-called wind ripples in which the ink flight trajectory fluctuates occur. If the fluctuation of the ink flight trajectory is generated, belt-shaped density unevenness occurs from the deviation of the ink landing position. It is desirable to suppress the generation of the density unevenness.

SUMMARY

An advantage of some aspects of the invention is to suppress the generation of the density unevenness.

According to an aspect of the invention, there is provided a print control apparatus which controls ejection of fluid from a nozzle array in which a plurality of nozzles are arranged in lines, and movement of the nozzle array in a direction intersecting a direction in which the nozzles are arranged in lines, in which the ejection of the fluid to the continued regions is performed by a plurality of movements of the nozzle array when an ejection amount of the fluid to continued regions in one movement of the nozzle array exceeds a predetermined threshold value.

Other characteristics of the invention are clearly defined in the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
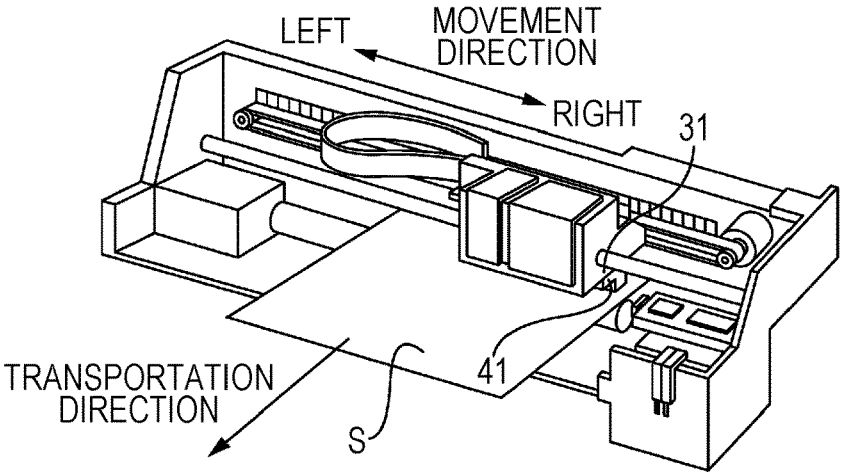
FIG. 1 is a perspective view illustrating a printer.

The following contents are clearly defined by the description of the specification and the accompanying drawings.

A print control apparatus controls ejection of fluid from a nozzle array in which a plurality of nozzles are arranged in lines, and movement of the nozzle array in a direction intersecting a direction in which the nozzles are arranged in lines, in which the ejection of the fluid to the continued regions is performed by a plurality of movements of the nozzle array when an ejection amount of the fluid to continued regions in one movement of the nozzle array exceeds a predetermined threshold value.

When the fluid is ejected in one movement of the nozzle array, there is concern that a phenomenon of so-called wind ripples may occur, and density unevenness may occur. However, since it is possible to divide the ejection of the fluid for one movement into the ejection of the fluid for a plurality of movements in the manner described above, it is possible to cause wind ripples to be unlikely to be generated. In addition, it is possible to suppress the generation of the density unevenness.

In the print control apparatus, it is desirable that a size of the region be differently set based on a distance between the medium and the nozzle array.

If the distance between the medium and the nozzle array changes, the easiness of the generation of the wind ripple phenomenon changes. Therefore, it is possible to appropriately suppress the generation of the wind ripples by varying the size of the region based on the distance between the medium and the nozzle array.

In addition, the threshold value may be differently set based on the distance between the medium and the nozzle array.

If the distance between the medium and the nozzle array changes, the easiness of the generation of the wind ripple phenomenon changes. Therefore, it is possible to appropriately suppress the generation of the wind ripples by varying the threshold value based on the distance between the medium and the nozzle array.

In addition, it is desirable that the threshold value be differently set according to the movement direction of the nozzle array.

When the nozzle array is formed on the head, the easiness of the generation of the wind ripples changes according to whether the nozzle array is positioned close to the movement direction of the head, or far from the movement direction of the head. Therefore, it is possible to appropriately suppress the generation of the wind ripples by varying the threshold value according to the movement direction of the nozzle array.

In addition, it is desirable that the adjacent nozzle arrays in the movement direction be set to have different threshold values from each other.

When a plurality of nozzle arrays are formed in the movement direction of the nozzle arrays, the adjacent nozzle arrays have the easiness of the generation of the wind ripples different from each other. Therefore, it is possible to appropriately suppress the generation of the wind ripples by setting the adjacent nozzle arrays to have different threshold values from each other.

In addition, it is desirable that the print control apparatus include at least an acceleration region and a deceleration region according to the movement of the nozzle array, and the threshold values be set to be different in the acceleration region and the deceleration region.

In this manner, when the print control apparatus includes at least an acceleration region and a deceleration region, the easiness of the generation of the wind ripples is different in the acceleration region and the deceleration region. Therefore, it is possible to appropriately suppress the generation of the wind ripples by setting the threshold value to be different in the acceleration region and the deceleration region.

At least the following contents are clearly defined by the description of the specification and the accompanying drawings.

A print control method includes controlling ejection of fluid from a nozzle array in which a plurality of nozzles are arranged in lines, and movement of the nozzle array in a direction intersecting a direction in which the nozzles are arranged in lines; determining whether an ejection amount of the fluid to continued regions in one movement of the nozzle array exceeds a predetermined threshold value; and causing the ejection of the fluid to the continued regions to be performed by a plurality of movements of the nozzle array when the ejection amount of the fluid exceeds the predetermined threshold value.

When the fluid is ejected in one movement of the nozzle array, there is concern that a phenomenon of so-called wind ripples may occur, and density unevenness may occur. However, since it is possible to divide the ejection of the fluid for one movement into the ejection of the fluid for a plurality of movements in the manner described above, it is possible to cause wind ripples to be unlikely to be generated. In addition, it is possible to suppress the generation of the density unevenness.

At least the following contents are clearly defined by the description of the specification and the accompanying drawings.

A program causes a print control apparatus to perform controlling ejection of fluid from a nozzle array in which a plurality of nozzles are arranged in lines, and movement of the nozzle array in a direction intersecting a direction in which the nozzles are arranged in lines; determining whether an ejection amount of the fluid to continued regions in one movement of the nozzle array exceeds a predetermined threshold value; and causing the ejection of the fluid to the continued regions to be performed by a plurality of movements of the nozzle array when the ejection amount of the fluid exceeds the predetermined threshold value.

When the fluid is ejected in one movement of the nozzle array, there is concern that a phenomenon of so-called wind ripples may occur, and the density unevenness may occur. However, since it is possible to divide the ejection of the fluid for one movement into the ejection of the fluid for a plurality of movements in the manner described above, it is possible to cause wind ripples to be unlikely to be generated. In addition, it is possible to suppress the generation of the density unevenness.

First Embodiment

Figure 2:
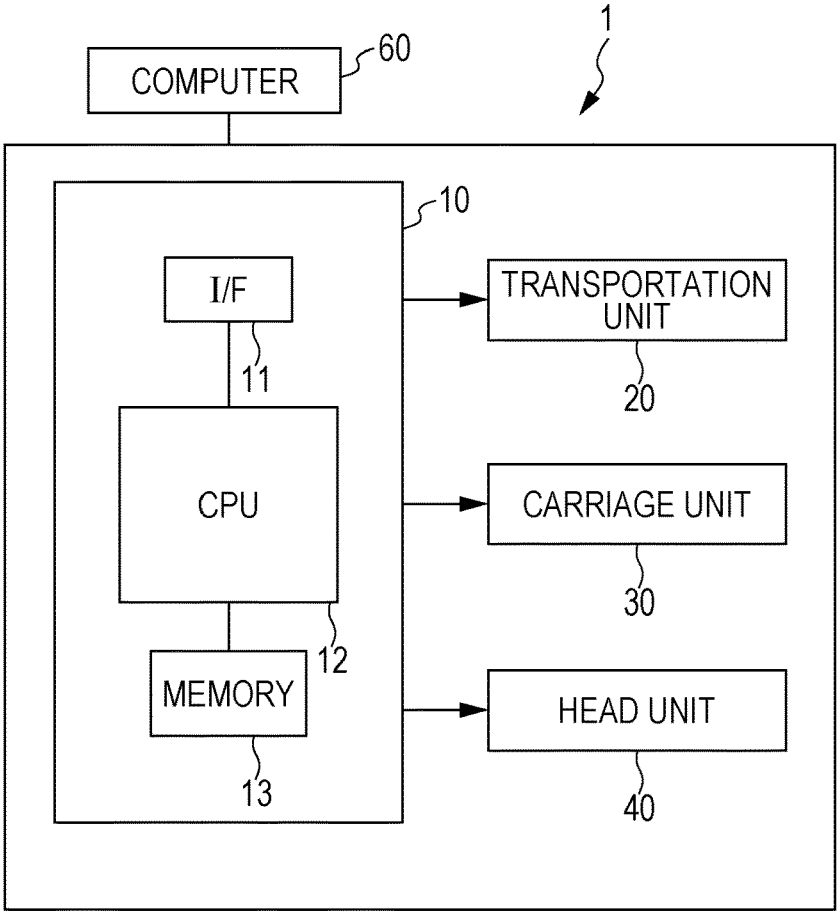
FIG. 2 is a block diagram illustrating an entire configuration of the printer.

FIG. 1 is a perspective view illustrating a printer 1. FIG. 2 is a block diagram illustrating an entire configuration of the printer 1. A computer 60 is communicably connected to the printer 1, and transports print data for causing the printer 1 to print an image to the printer 1. In addition, a program (printer driver) for converting image data output from the application program into print data is installed in the computer 60. The printer driver can be stored in the recording medium (computer-readable recording medium) such as a CD-ROM, or downloaded on the computer via the Internet.

As described below, when an ejection duty of a continued region formed on the sheet by the ejection of ink in one pass of the head 41 exceeds a predetermined threshold value, the computer 60 in which the printer driver is installed corresponds to a printing apparatus that causes the dots formed for one pass to be formed for a plurality of passes.

A controller 10 is a control unit for controlling respective portions of the printer 1. An interface portion 11 performs transportation and reception of data between the computer 60 and the printer 1. A CPU 12 is an arithmetic processing apparatus for controlling the entire printer 1. A memory 13 secures a region for storing a program of the CPU 12, a working region, or the like.

A transportation unit 20 sends a medium S to a printable position, and can transport the medium S by a predetermined transportation amount in the transportation direction when printing. A carriage unit 30 moves the head 41 in a movement direction intersecting the transportation direction, and includes a carriage 31.

A head unit 40 ejects ink to the medium S, and includes the head 41. The head 41 is moved in the movement direction by the carriage 31. A plurality of nozzles which are an ink ejecting portion are provided on the lower surface of the head 41 and an ink chamber (not illustrated) including ink is provided to each nozzle.

Figure 3:
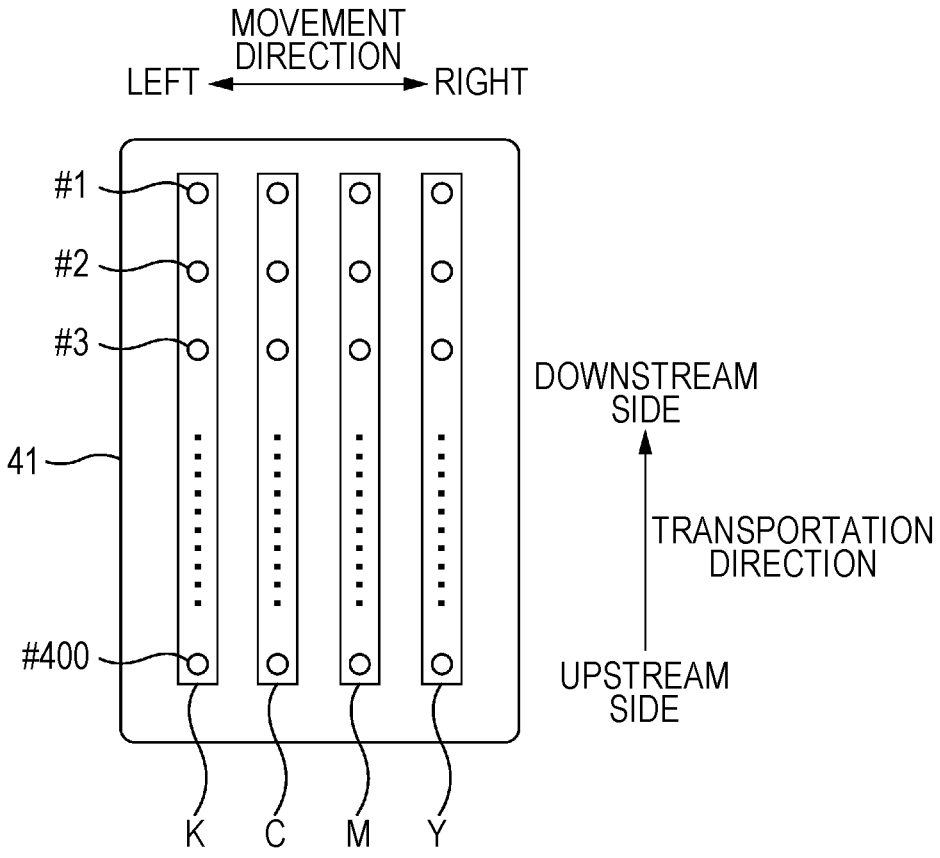
FIG. 3 is a diagram illustrating an arrangement of the nozzles provided on the lower surface of the head.

FIG. 3 is a diagram illustrating an arrangement of the nozzles provided on the lower surface of the head 41. In addition, the drawing transparently illustrates nozzles from the upper surface of the head 41. On the lower surface of the head 41, 400 nozzles are provided so as to form 5 columns of nozzle arrays at a predetermined interval in the transportation direction. The 400 nozzles are arranged in lines at even intervals in the scope of 1 inch so that the nozzle arrays with a high density are configured.

On the lower surface of the head 41, a black ink nozzle array K that ejects black ink, a cyan ink nozzle array C that ejects cyan ink, a magenta ink nozzle array M that ejects magenta ink, and a yellow ink nozzle array Y that ejects yellow ink are arranged in lines in the movement direction. In addition, 400 nozzles included in the respective nozzle arrays on the lower side in the transportation direction are sequentially denoted by the smaller nozzle numbers (#1 to #400).

The printer 1 repeatedly performs a process dot formation process of forming dots on a medium by intermittently ejecting ink droplets from the head 41 that moves in the movement direction, and a transportation process of transporting the medium to the head 41 in the transportation direction. Accordingly, in the next dot formation process, dots can be formed at positions on the medium which are different from positions of dots formed in the previous dot formation process so that a two dimensional image can be printed on the medium. In addition, an operation of the head 41 moving one time in the movement direction while ejecting ink droplets is referred to as a "pass".

Figure 4:
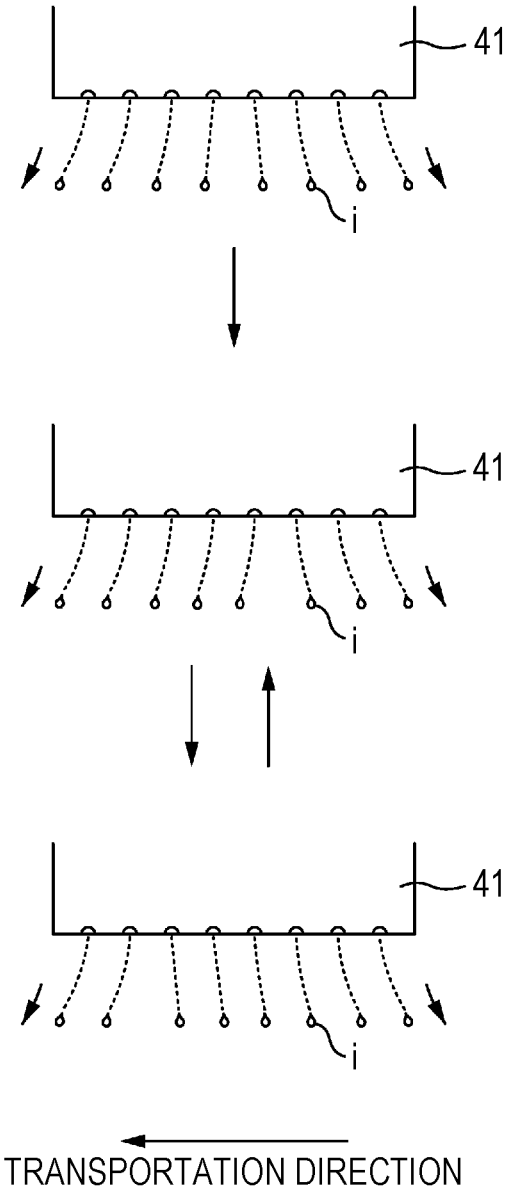
FIG. 4 is a diagram illustrating wind ripples.

FIG. 4 is a diagram illustrating wind ripples. In FIG. 4, the head 41 and trajectories of ink i ejected from respective nozzles of the head 41 are illustrated.

In the recent printer 1, the density of nozzles is high, and ejection frequency of the ink is set to be high in many cases. The ejection frequency relates to the ejection interval of the ink, for example, if the ejection frequency is set to be high, the ejection interval of the ink becomes short. Also, if the density of the nozzles is high or the ejection frequency is high, respective drops of the ink i spread to the outside in the nozzle array direction by the interaction between the drops of the ink (drawing on upper side in FIG. 4). Further, if the head 41 ejects ink from the nozzles with the high density at the high frequency while moving, the flight trajectory of the ink changes and fluctuates every moment. This phenomenon is referred to as wind ripples. The wind ripples grow as time passes. Accordingly, according to the growth, the wind ripples fluctuate so that the states in the middle and on the lower side in FIG. 4 are repeated. If the barrage of ink generated by ejecting ink at the high frequency from the nozzles with the high density is compared to a curtain, the wind ripples are a phenomenon presented by the movement of the head in the same manner as the curtain flutters in the wind.

Figure 5:
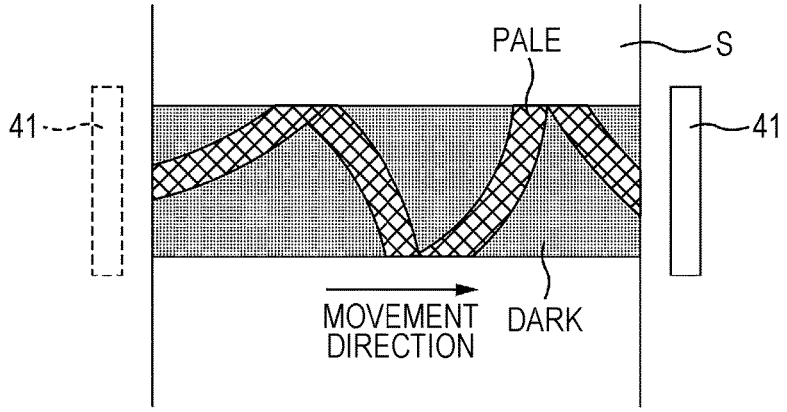
FIG. 5 is a diagram illustrating an example of printing performed when wind ripples are generated.

FIG. 5 is a diagram illustrating an example of printing performed when wind ripples are generated. FIG. 5 illustrates a sheet S and the head 41 ejecting the ink on the sheet S. Also, the tone of the image formed when the head 41 moves in the movement direction while ejecting ink from all the black ink nozzles of the head 41 is illustrated.

As described above, if the wind ripples grow and fluctuate, density unevenness in which the image has a light portion and a dark portion according to the fluctuation is generated. Since such density unevenness causes the decrease of the image quality, the unevenness should be suppressed. Accordingly, in the first embodiment, the generation of the density unevenness is suppressed by the printing process described below.

Figure 6:
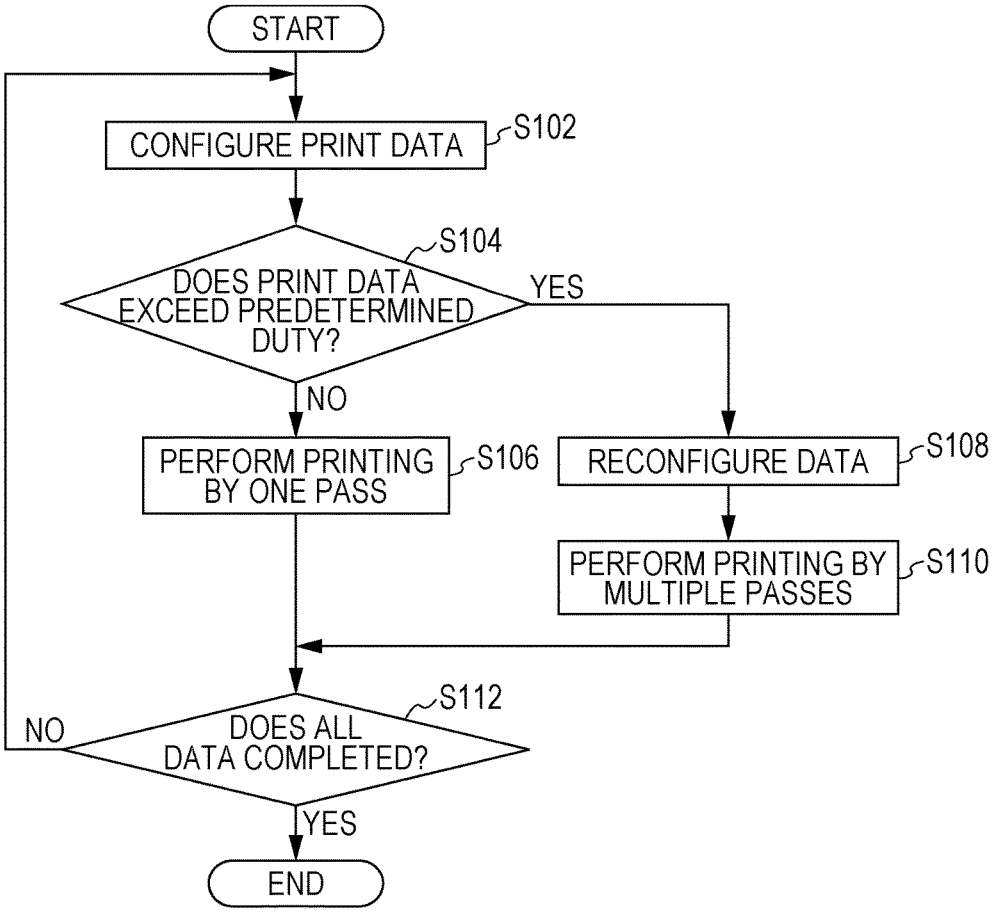
FIG. 6 is a flow chart of a printing process according to the first embodiment.

FIG. 6 is a flow chart of a printing process according to the first embodiment. The printing process is performed by the computer 60.

If the printing process is started, print data is configured based on the image data (S102). Here, the image data is 256 RGB gradation data in each image. Meanwhile, the print data is data indicating which size of dots among small dots, middle dots, and large dots and which color of dots are formed (or are not formed) for respective printing pixels of the printer 1 when the printer 1 performs printing. By obtaining the print data, it is possible to calculate to which area and how much of an amount of ink is to be ejected.

Next, it is determined whether there is a standard region having an ejection duty that exceeds the standard ejection duty as the threshold value based on the print data corresponding to one pass (hereinafter, the condition is referred to as the "determination condition") (S104). As described above, the one pass is an operation in which the head 41 moves one time in the movement direction while ejecting ink droplets. For example, the standard region is a region in which 50 continuously arranged nozzles continuously eject 100 shots of ink. For example, the standard ejection duty can be set to the ejection duty corresponding to 70% of an ejection duty when 50 continuously arranged nozzles continuously eject 100 shots of ink with a large size.

Figure 7:
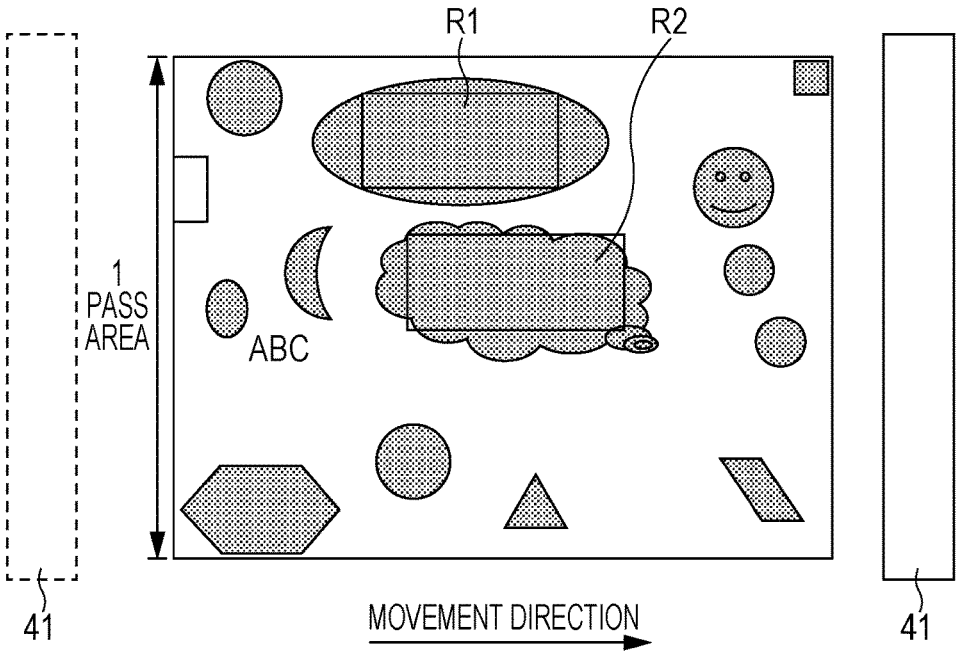
FIG. 7 is a diagram illustrating a determination condition.

FIG. 7 is a diagram illustrating a region having an ejection duty exceeding the standard ejection duty. FIG. 7 illustrates the head 41 and an image that can be formed by one pass of the head 41. In FIG. 7, as standard regions having ejection duties exceeding the standard ejection duty, a region R1 and a region R2 are illustrated. The region R1 and the region R2 are also regions having patterns with a high density. Therefore, if these are printed by one pass, since the ink is ejected for a long time at a high frequency from nozzles with the high density, the wind ripple phenomenon is easily generated. Accordingly, as described below, printing is performed on the regions by a plurality of passes, in order to suppress the wind ripple phenomenon.

When there is a standard region having an ejection duty exceeding the standard ejection duty in the print data for one pass, if the printing is performed by one pass, the possibility that wind ripples are generated is high. Therefore, the print data is reconstructed so that the print data for one pass can be printed by a plurality of passes (S108). The reconstruction of the print data refers to dividing a pass as described below. Also, printing is performed by a plurality of passes based on the reconstructed print data (S110).

Meanwhile, if there is not a standard region having an ejection duty exceeding the standard ejection duty in the print data for one pass, the print data for one pass is printed by one pass (S106).

Figure 8:
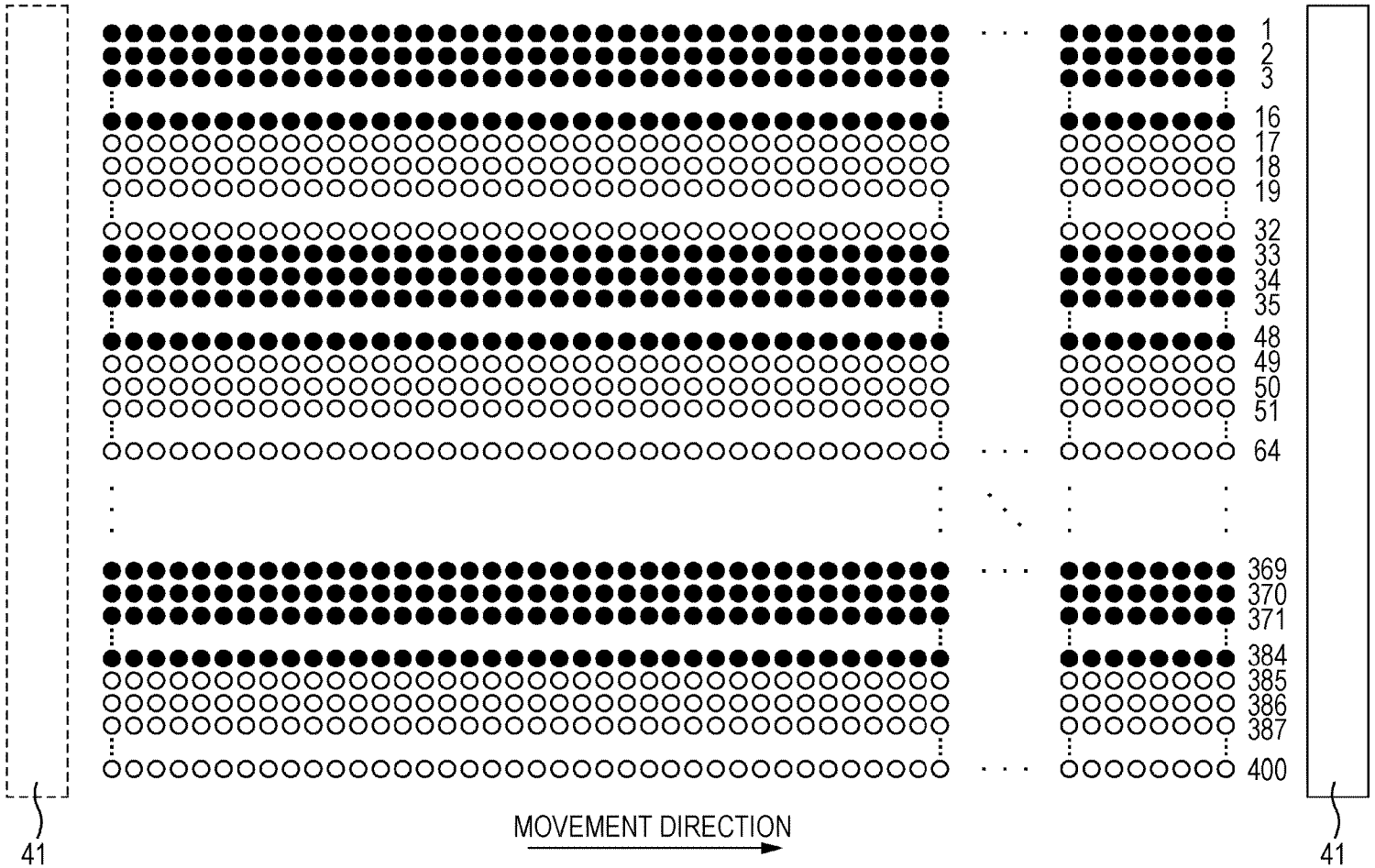
FIG. 8 is a diagram illustrating a method of dividing a pass.

FIG. 8 is a diagram illustrating a method of dividing a pass. FIG. 8 illustrates the head 41 and nozzles ejecting ink when one pass is divided into a first pass and a second pass.

In FIG. 8, black circles are dots to be printed by the first pass. Meanwhile, white circles are dots to be printed by the second pass. Originally, all dots illustrated in FIG. 8 can be formed by one pass, but when the printing is performed with two passes as described above, for example, dots are divided into dots to be formed by the first pass and dots to be formed by the second pass with 16 nozzles. Also, the division unit is 16 nozzles herein, but the division unit may be changed according to types of machines. Accordingly, according to the determination region satisfying the determination condition above, the printing is performed with a plurality of passes so that wind ripples are unlikely to be generated.

Next, it is determined whether the printing for all print data is completed or not (S112). If printing is completed for all data, the printing process ends. Meanwhile, if the printing for all print data is not completed, the process returns to Step S102, and the steps described above are performed again.

As described above, if there is concern that the wind ripple phenomenon may occur, it is possible to divide fluid ejection for one movement into fluid ejection for a plurality of movements. Therefore, wind ripples are unlikely to be generated. Also, it is possible to suppress the generation of the density unevenness.

In addition, it is possible to independently change the standard region and the standard ejection duty. For example, the standard region can be changed by changing the condition of the number of continuously arranged nozzles, or the condition of the number of the continuously ejected shots. Also, the standard ejection duty can be changed by changing the condition of the condition of the dot sizes, the condition of the number of continuously arranged nozzles, the number of the continuously ejected shots, or the condition of the percentage of multiplication thereof.

Second Embodiment

In the first embodiment described above, the determination condition is whether there is a standard region having an ejection duty exceeding the standard ejection duty. According to the second embodiment, the print data corresponding to one pass is divided into blocks of predetermined units, and the print data corresponding to one pass is divided into the print data for multiple passes based on whether a predetermined number of blocks having ejection duties exceeding a predetermined ejection duty exist.

Figure 9:
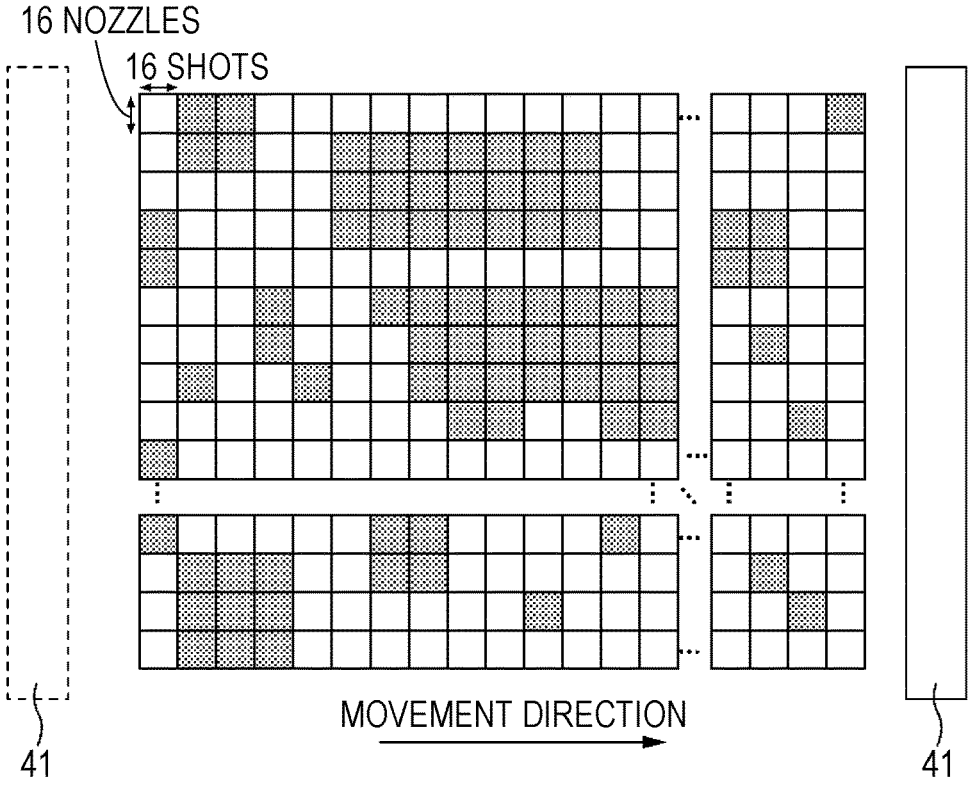
FIG. 9 is a diagram illustrating a determination condition according to a second embodiment.

FIG. 9 is a diagram illustrating a determination condition according to the second embodiment. In FIG. 9, raster data for one pass is divided into blocks so that one block has 16 nozzles×16 shots as a unit. Also, among the blocks divided in this manner, it is determined whether there is a block of which a large dot conversion ejection duty exceeds 70%. Here, the large dot conversion ejection duty of 100% in one block means an ejection duty when all 16 nozzles×16 shots in one block form large dots.

After the ejection duties of block units are determined, it is determined whether blocks having large dot conversion ejection duty exceeding 70% continuously exist by 3 blocks vertically×6 blocks horizontally (S104).

If blocks having the large dot conversion ejection duty exceeding 70% continuously exist by 3 blocks vertically×6 blocks horizontally, print data is reconstructed so that print data for one pass is printed by a plurality of passes (S108), and the printing is performed by the plurality of passes (S110). Meanwhile, if continued blocks do not exist, the printing is performed by one pass (S106).

Also in this manner, when there is concern that the wind ripple phenomenon may be generated, the fluid ejection by one movement can be divided into ejection by a plurality of movements. Therefore, wind ripples are unlikely to be generated. Also, it is possible to suppress the generation of the density unevenness.

Third Embodiment

Figure 10:
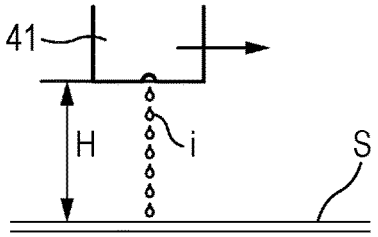
FIG. 10 is a diagram illustrating a platen gap.

FIG. 10 is a diagram illustrating a platen gap. In FIG. 10, the head 41, the sheet S, and a distance H between the head 41 and the sheet S (hereinafter, the platen gap H) are illustrated.

In general, if the platen gap H is small, the wind ripple phenomenon is unlikely to occur, and if the platen gap H is great, the wind ripple phenomenon easily occurs. This is because when the platen gap H is small, even if the flight trajectory of the ink fluctuates, the deviation of the landing position of the ink is small.

Accordingly, in the third embodiment, the size of the standard region changes according to the platen gap H. For example, as the platen gap H is smaller, the size of the standard region is set to be bigger, and as the platen gap H is greater, the size of the standard region is set to be smaller. That is, as the platen gap H is greater, it is possible to set the determination condition to be strict.

In addition, according to the platen gap H, it is possible to cause the standard ejection duty to be different. For example, as the platen gap H is smaller, the standard ejection duty is set to be great, and as the platen gap H is greater, the standard ejection duty is set to be small. That is, as the platen gap H is greater, the determination condition can be set to be strict.

Fourth Embodiment

Figure 11:
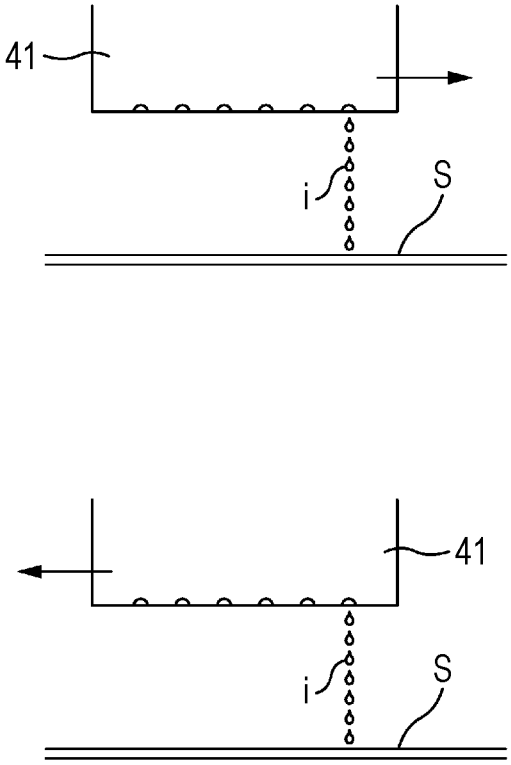
FIG. 11 is a first diagram illustrating that wind ripples are easily generated.

FIG. 11 is a first diagram illustrating that wind ripples are easily generated. On the upper side of FIG. 11, it is illustrated that the ink is ejected in the outward way of the head 41, that is, the ink is ejected from the nozzle array close to the movement direction of the head 41. Meanwhile, on the lower side of FIG. 11, it is illustrated that the ink is ejected in the inward way of the head 41, that is, the ink is ejected from the nozzle array far from the movement direction of the head 41.

The nozzle array that ejects ink on the upper side of FIG. 11, and the nozzle array that ejects ink on the lower side of FIG. 11 are the same nozzle array, but the movement direction thereof is different to be the outward way and the inward way.

If the generation degree of the wind ripples when the ink is ejected as illustrated on the upper side of FIG. 11 and the generation degree of the wind ripples when the ink is ejected as illustrated on the lower side of FIG. 11 are compared, the wind ripples are more easily generated when the ink is ejected from the nozzle array far from the movement direction of the head than when the ink is ejected from the nozzle array close to the movement direction of the head. It is considered that this is because trajectory of the ink ejected from the nozzle array far from the movement direction is disturbed due to the disturbance of the air stream between the head 41 and the sheet S by the movement of the head 41.

Accordingly, in the fourth embodiment, the standard ejection duty is differently set according to whether the nozzle array is close to or far from the movement direction of the head 41. For example, it is possible to set the standard ejection duty when the ink is ejected from the nozzle array far from the movement direction of the head 41 to be smaller than that when the ink is ejected from the nozzle array close to the movement direction of the head 41.

In addition, it is possible to set the size of the standard region when the ink is ejected from the nozzle array far from the movement direction of the head 41 to be smaller than that when the ink is ejected from the nozzle array close to the movement direction of the head 41.

That is, herein, it is possible to set the determination condition when the ink is ejected from the nozzle array far from the movement direction of the head to be stricter than that when the ink is ejected from the nozzle array close to the movement direction of the head 41.

Fifth Embodiment

Figure 12:
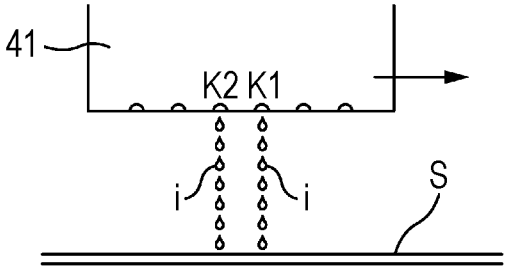
FIG. 12 is a second diagram illustrating that wind ripples are easily generated.

FIG. 12 is a second diagram illustrating that wind ripples are easily generated. In FIG. 12, the head 41 and the sheet S are illustrated. The head 41 according to the fifth embodiment includes two arrays of black ink nozzle arrays: a first black ink nozzle array K1 in the middle of the head and a second black ink nozzle array K2. Also, the head 41 moves in the movement direction and ejects the ink i from the two black ink nozzle arrays.

In the head 41 in which two nozzle arrays are adjacent to each other, the ink ejected from the first black ink nozzle array K1 and the ink ejected from the second black ink nozzle array K2 are different from each other in the easiness of the generation of the wind ripples.

In such a head 41, since the ink ejected from the first black ink nozzle array K1 receives the resistance of the air caused by the movement of the head 41 earlier than the ink ejected from the second black ink nozzle array K2, the wind ripples are more easily generated in the ink ejected from the first black ink nozzle array K1. Meanwhile, since the air resistance is absorbed by the ink ejected from the first black ink nozzle array K1, the wind ripples are unlikely to occur in the ink ejected from the second black ink nozzle array K2.

Accordingly, in the fifth embodiment, the two adjacent nozzle arrays have different standard ejection duties from each other. For example, it is possible to set the standard ejection duty when the ink is ejected from the nozzle array close to the movement direction of the head 41 to be smaller than that when the ink is ejected from the nozzle array far from the movement direction of the head 41.

In addition, it is possible to set the size of the standard region when the ink is ejected from the nozzle array close to the movement direction of the head 41 to be smaller than that when the ink is ejected from the nozzle array far from the movement direction of the head 41.

That is, it is possible to set the determination condition when the ink is ejected from the nozzle array close to the movement direction of the head 41 to be stricter than that when the ink is ejected from the nozzle array far from the movement direction of the head 41.

Sixth Embodiment

Figure 13:
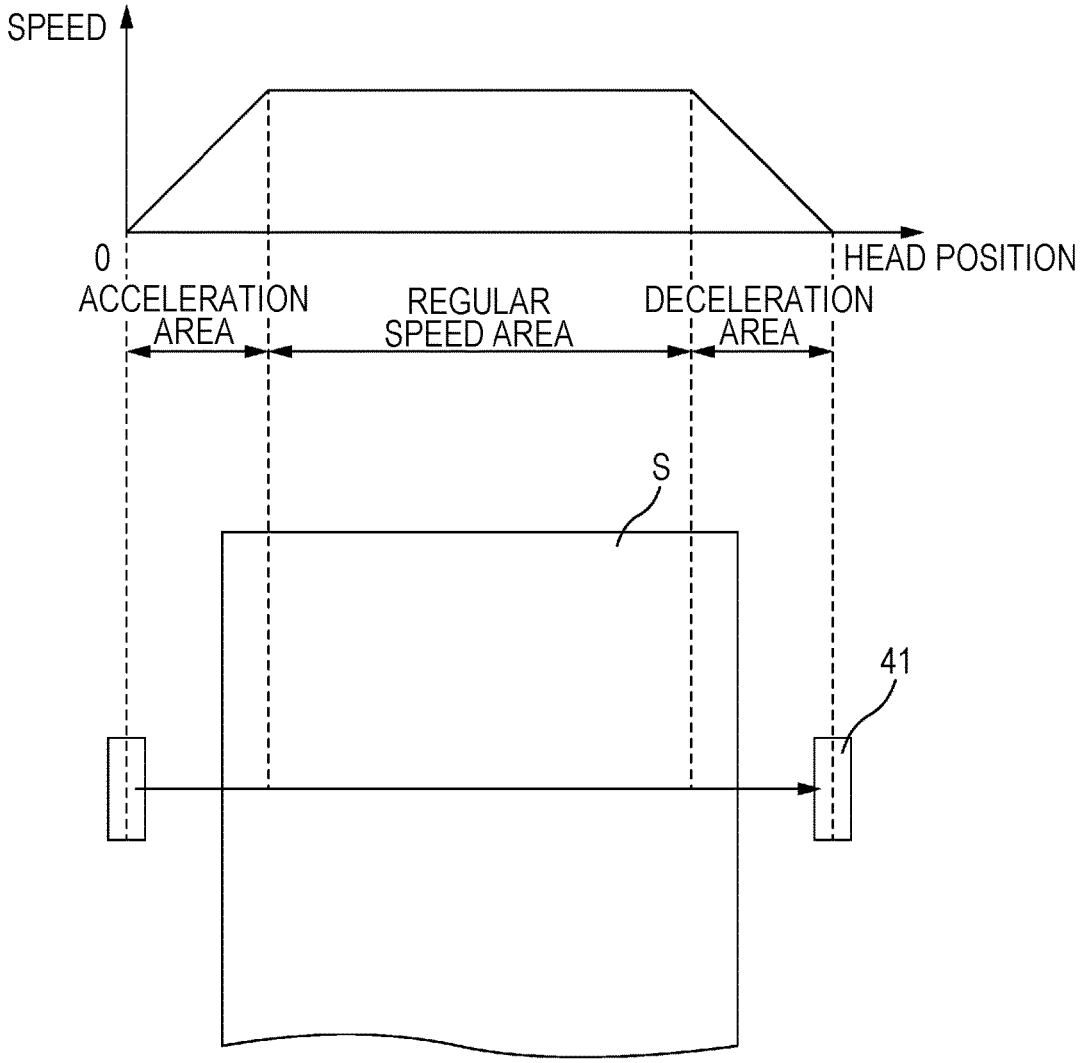
FIG. 13 is a third diagram illustrating that wind ripples are easily generated.

FIG. 13 is a third diagram illustrating that wind ripples are easily generated. In FIG. 13, the speed of the head with respect to the head position when the head 41 performs printing on the sheet S is illustrated. The head 41 performs printing while moving in the sheet width direction, but the head 41 reciprocates in the movement direction, so the speed thereof is not regular all the time, and there are an acceleration region and a deceleration region.

Also, the wind ripples are more easily generated in the deceleration region, than in the acceleration region and the regular speed region. This is because the wind ripples become greater in the deceleration region by the deceleration, since the flow of the air is unlikely to go between the head 41 and the sheet S.

Accordingly, in the sixth embodiment, the standard ejection duty in the deceleration region is set to be different from those in the acceleration region and the regular speed region. For example, it is possible to set the standard ejection duty employed in the deceleration region to be smaller than those employed in the acceleration region and the regular speed region.

In addition, it is possible to set the size of the standard region employed in the deceleration region to be smaller than those employed in the acceleration region and the regular speed region. That is, it is possible to set the determination condition when the ink is ejected in the deceleration region to be stricter than when the ink is ejected in the acceleration region and the regular speed region.

Other Embodiments

In addition, an example in which the computer 60 operated by a printer driver is used as a print control apparatus is described, but it is possible to use the controller 10 of the printer 1 as the print control apparatus. In addition, it is possible to set the computer 60 and the controller 10 to correspond to the printing apparatus.

In addition, the aspect of the nozzle arrangement is not limited to the aspect illustrated in FIG. 3. For example, in order to enhance the resolution, a configuration in which nozzle arrays of respective ink colors form a staggered arrangement, or a configuration in which one nozzle array is divided into three nozzle groups of ink colors of cyan, magenta, and yellow according to the transportation direction is possible. When the staggered arrangement is employed, the ejection amount can be determined for both of the two arrays, or may be determined respectively for the two arrays.

Also, in the embodiment described above, the number of passes is increased from one pass to two passes. However, when there is concern that the wind ripple phenomenon may occur even if the number of passes is increased to two, the number of passes may be increased to three. In addition, when printing is performed by multi-pass such as two passes, the number of passes may be increased to more than two such as three or four.

In the embodiment described above, the printer 1 is described as a control target controlled by the print control apparatus, but the invention is not limited thereto. The invention may be realized in a liquid discharging apparatus that ejects or discharges fluid (liquid, liquid state body in which particles of functional materials are dispersed, and fluid state body such as gel) other than ink. For example, the technique the same as the embodiment described above can be applied to various types of apparatuses practically using ink jet techniques such as a color filter manufacturing apparatus, a dyeing apparatus, a fine machining apparatus, a semiconductor manufacturing apparatus, a surface machining apparatus, a three-dimensional shaping machine, a gas evaporating apparatus, an organic EL manufacturing apparatus (specifically, macromolcular EL manufacturing apparatus), a display manufacturing apparatus, a film formation apparatus, and a DNA chip manufacturing apparatus. In addition, such methods and manufacturing methods are within the application range.

The embodiments described above are provided for easier understanding of the invention, and are not intended to be construed to limit the invention. The invention can be changed and improved without departing from the gist, and also the invention includes equivalents thereof.

What is claimed is:

1. A print control apparatus which controls ejection of fluid from a nozzle array in which a plurality of nozzles are arranged in lines, and movement of the nozzle array in a direction intersecting a direction in which the nozzles are arranged in lines, wherein a first determining section determines whether a number of the nozzles used to eject ink in one nozzle group, which consists of a predetermined number of continuously arranged nozzles in the nozzle-array which continuously eject fluid, exceeds a first predetermined threshold value during one ejection of the nozzle-array in a single scanning pass, wherein a second determining section determines, when the first determining section has determined that the number of nozzles used to eject ink in the one nozzle group exceeds the first predetermined threshold value, whether an ejection amount of the fluid ejected from the one nozzle group to an ejection region in the single scanning pass exceeds a second predetermined threshold value, wherein when the ejection amount of the fluid ejected in the one nozzle group exceeds a second predetermined threshold value, the ejection of the fluid from the nozzle-array to the ejection region is performed in multiple scanning passes, wherein a number of passes of the multiple scanning passes is more than a number of passes originally required.

2. The print control apparatus according to claim 1, wherein a size of the ejection region is differently set based on a distance between the medium and the nozzle array.

3. The print control apparatus according to claim 1, wherein the second predetermined threshold value is differently set based on the distance between the medium and the nozzle array.

4. The print control apparatus according to claim 1, wherein the second predetermined threshold value is differently set according to the movement direction of the nozzle array.

5. The print control apparatus according to claim 1, wherein the second predetermined threshold value is different for adjacent nozzle groups in the nozzle array in the movement direction.

6. The print control apparatus according to claim 1, further comprising:

at least an acceleration region and a deceleration region according to the movement of the nozzle array, wherein the first and second predetermined threshold values are set to be different in the acceleration region and the deceleration region.

7. A print control method comprising:

controlling ejection of fluid from a nozzle array in which a plurality of nozzles are arranged in lines, and movement of the nozzle array in a direction intersecting a direction in which the nozzles are arranged in lines;

determining whether a number of the nozzles used to eject ink in one nozzle group, which consists of a predetermined number of continuously arranged nozzles in the nozzle-array which continuously eject fluid, exceeds a first predetermined threshold value during one ejection of the nozzle-array in a single scanning pass;

determining, when it has been determined that the number of nozzles used to eject ink in the one nozzle group exceeds the first predetermined threshold value, whether an ejection amount of the fluid ejected from the one nozzle group to an ejection region in the single scanning pass exceeds a second predetermined threshold value; and causing the ejection of the fluid from the nozzle-array to the ejection region to be performed in multiple scanning passes when the ejection amount of the fluid ejected in the one nozzle group exceeds a second predetermined threshold value, wherein a number of passes of the multiple scanning passes is more than a number of passes originally required.

8. A non-transitory computer readable storage medium storing computer program, the program causing a print control apparatus to perform:

controlling ejection of fluid from a nozzle array in which a plurality of nozzles are arranged in lines, and movement of the nozzle array in a direction intersecting a direction in which the nozzles are arranged in lines;

determining whether a number of the nozzles used to eject ink in one nozzle group, which consists of a predetermined number of continuously arranged nozzles in the nozzle-array which continuously eject fluid, exceeds a first predetermined threshold value during one ejection of the nozzle-array in a single scanning pass;

determining, when it has been determined that the number of nozzles used to eject ink in the one nozzle group exceeds the first predetermined threshold value, whether an ejection amount of the fluid ejected from the one nozzle group to an ejection region in the single scanning pass exceeds a second predetermined threshold value; and causing the ejection of the fluid from the nozzle-array to the ejection region to be performed in multiple scanning passes when the ejection amount of the fluid ejected in the one nozzle group exceeds a second predetermined threshold value, wherein a number of passes of the multiple scanning passes is more than a number of passes originally required.

* * * * *